United States Patent [19]

Masuda et al.

[11] 4,443,161

[45] Apr. 17, 1984

[54] BALANCED DUAL CHAMBER OIL PUMP

[75] Inventors: Naosuke Masuda; Takeshi Ohe, both of Higashimatsuyama, Japan

[73] Assignee: Jidosha Kiki Co., Ltd., Tokyo, Japan

[21] Appl. No.: 378,746

[22] Filed: May 17, 1982

[30] Foreign Application Priority Data

May 25, 1981 [JP] Japan ..... 56-79083

[51] Int. Cl.[3] ..... F04B 47/08

[52] U.S. Cl. ..... 417/310; 417/304; 417/308

[58] Field of Search ..... 417/300, 304, 308, 310

[56] References Cited

U.S. PATENT DOCUMENTS 2,887,060 5/1959 Adams et al. ..... 417/310 X
2,910,944 11/1959 Pettibone ..... 417/310 X
3,067,689 12/1962 Hause .

FOREIGN PATENT DOCUMENTS 205528 3/1956 Australia ..... 417/310
801069 9/1958 United Kingdom .
2038933 7/1980 United Kingdom .

*Primary Examiner*—Richard E. Gluck
*Attorney, Agent, or Firm*—Charles E. Pfund

[57] ABSTRACT

In an oil pump of the type comprising a cartridge having an elliptical cam ring in which a rotor having a plurality of vanes is rotated to form a pair of pump chambers symmetric with respect to an axis of rotor, and a pair of suction passages and two pairs of discharge passages are provided for the pair of pump chambers. A valve opening is formed coaxially with the rotor in a pump body secured to one side of the cartridge to contain the spool valve. A metering orifice is provided in a discharge passage to actuate the spool valve in response to a pressure differential such that when the pump speed is low all outputs of both pump chambers are supplied to a load, whereas when the pump speed is high a portion of the outputs is supplied the suction side. According to this construction it is possible to decrease power consumption and to decrease the size and weight of the oil pump.

7 Claims, 8 Drawing Figures

FIG.4
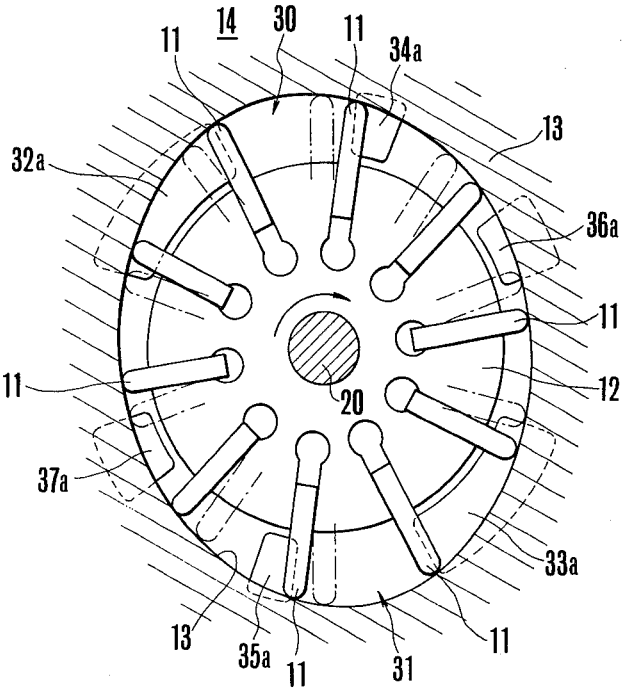
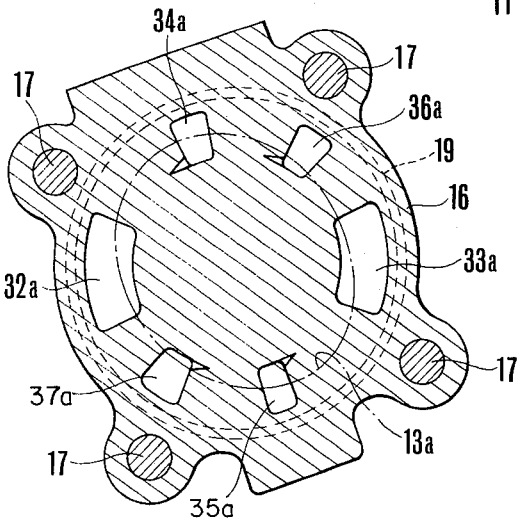
FIG.5

FIG.6
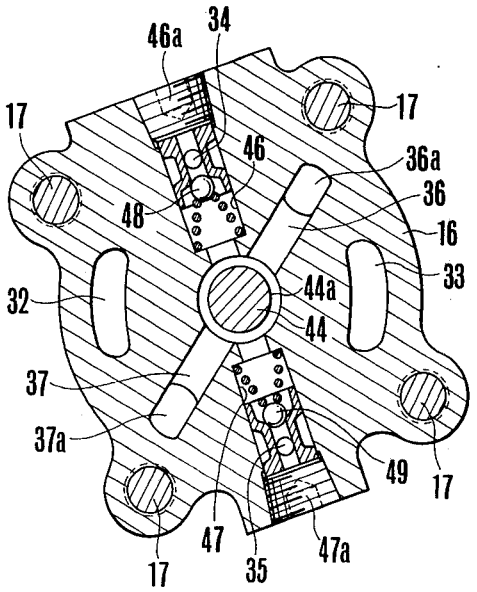
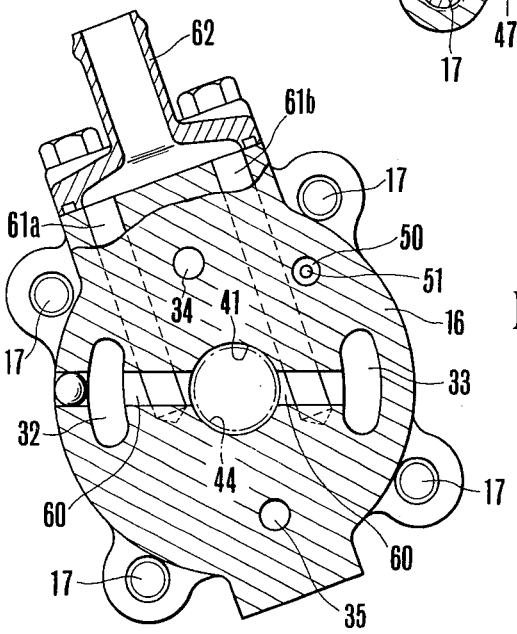
FIG.7

BALANCED DUAL CHAMBER OIL PUMP

BACKGROUND OF THE INVENTION

This invention relates to a balanced vane type oil pump, and more particularly a small, light weight and low cost oil pump wherein a pair of pump cartridges are commonly used as two pumps and the supply of pressurized oil from both pumps is selectively controlled.

An oil pump acting as a source of oil pressure for a power steering device which is used for the purpose of decreasing the handle operating power required for a motor car driver or other engine driven vehicles is usually driven by the engine of the vehicle and its quantity of discharge varies in proportion to the number of revolutions of the engine. For this reason such oil pump is required to have a capacity sufficient to supply a quantity of pressurized oil necessary to operate the power steering device or other load even when the engine rotates at a low speed, in other words, the discharge quantity of the pump is small. However, when the pump is designed to have such a large capacity, where the engine operates at a high speed, the discharge quantity of the pump becomes surplus, which is not only uneconomical but also increases consumption of the engine horse power, thereby increasing fuel consumption.

For this reason, it has been proposed an improved oil pump in which a pair of pump cartridges are used as two pumps of small capacities and a control device having fluid passage transfer function is combined with the cartridges for selectively supplying pressurized oils from the two pumps. More particularly, in this improved arrangement, where the discharge quantity of each pump is small, the sum of the outputs of two pumps is supplied to the load, whereas when the discharge quantity of each pump increases the pressurized oil from only one of the pumps is supplied to the load and to the suction side of the other pump thus circulating the oil. With this measure, it is possible to decrease the horse power required for driving the pumps thus decreasing the horse power consumption.

When constructing such advantageous apparatus, it is necessary to consider a constructional problem which occurs when a pair of pump cartridges consisting of a rotor including vanes and cam rings is used as two pumps.

Thus, since a pair of pump cartridges are used as two pumps, as the simplest construction, may be used a construction wherein a pair of pump chambers formed at positions symmetrical with respect to the rotor axis are separated and connected to separate discharge passages. One example of this construction is disclosed in British Laid Open Patent Specification GB-2038,933A. With this construction, however, although it is possible to simplify the construction of the pump passages and the control device, when one of the pump chambers is connected to the side of an oil tank or reservoir to unload the pump, since only the other pump chamber provides pumping action, an unbalanced load is imposed upon the rotor and its driving shaft so that the durability and the reliability of the movable portions of the pumps are affected. Furthermore such unbalanced load causes noise.

A balanced type oil pump free from this problem is disclosed in U.S. Pat. No. 2,887,060. According to the construction disclosed in this patent, a pair of pump chambers formed about a rotor at positions symmetrical with respect to the axis of the rotor and connected to two independent discharge passages and the outputs of the paired passages opened in respective pump chambers at positions symmetrical with respect to the rotor axis are combined with the pump chambers so as to utilize the pair of pump chambers as independent chambers. This construction, however, increases the number of oil passages with the result that connections of the passages and the pipings to spool valves acting as control devices become complicated.

Since it is usual to incorporate the pump cartridge, the control device and oil passages into a single pump body, various problems described above have a great influence upon the manufacturing, assembling and cost of the entire pump. In addition, this construction increases the overall size of the pump.

In the oil pump of this type, it is desirable to simplify the overall construction and assembling, to make small and light and to decrease the manufacturing cost. Such desire is remarkable especially for a power steering device which is mounted in a small space in an engine room. Consequently, it has been desired to provide an improved oil pump consuming less energy and can fulfill all of these desires.

SUMMARY OF THE INVENTION

It is an object of this invention to provide an improved oil pump capable of fulfilling all of these desires.

Another object of this invention is to provide an improved oil pump capable of using most of the component parts of the conventional oil pump of the similar type.

According to this invention, there is provided an oil pump comprising a pump body including a rotor, a cam ring surrounding the rotor and formed with a pair of pump chambers at positions symmetrical with respect to the axis of the rotor, suction passages and first and second discharge passages opening in the pump chambers at positions a predetermined distance apart in the direction of the rotor, a flow control valve formed in the axial direction of the pump body and including a valve opening and spool slidable therein, one pair of the discharge passages opening at one end of the valve opening while the other pair opening at an axial center of the valve opening at opposing positions, the passages opening at the axial center of the valve opening being normally closed by the spool biased to an inoperative position, check valve, located between two pairs of discharge passages, the suction passages opening in the valve opening between the openings of the two pairs of the discharge passages at opposing positions, whereby when the spool is operated, the suction passages are firstly communicated with the other pair of discharge passages opening at the axial center of the valve opening and then communicated with the one pair of the discharge passages.

BRIEF DESCRIPTION OF THE DRAWINGS

These and further objects and advantages of this invention can be more fully understood from the following detailed description taken in conjunction with the accompanying drawings in which:

FIG. 4 is a sectional view showing the relation among respective oil passages and the pump chamber in a case wherein a pair of pump cartridges are used as two pumps;

FIGS. 5, 6 and 7 are sectional views respectively taken along lines V—V, VI—VI and VII—VII in FIG. 1.

DESCRIPTION OF THE PREFERRED EMBODIMENT

Figure 1:
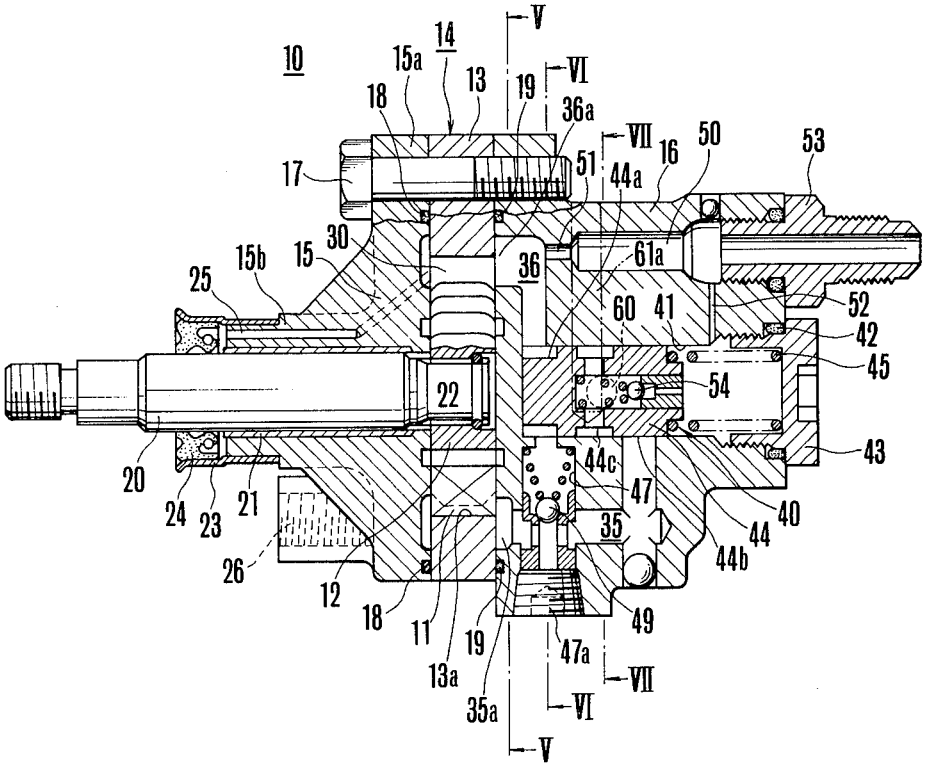
FIG. 1 is a longitudinal sectional view taken along a line I—I shown in FIG. 3 and showing the overall construction of one embodiment of an oil pump according to this invention.
Figure 2:
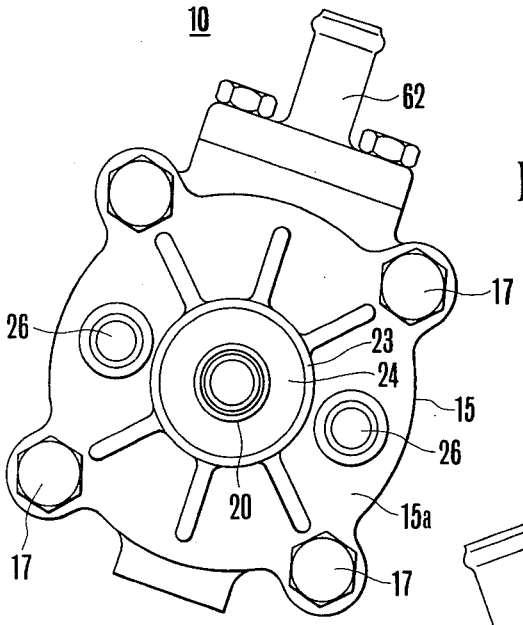
FIG. 2 is a front end view of the pump shown in FIG. 1.
Figure 3:
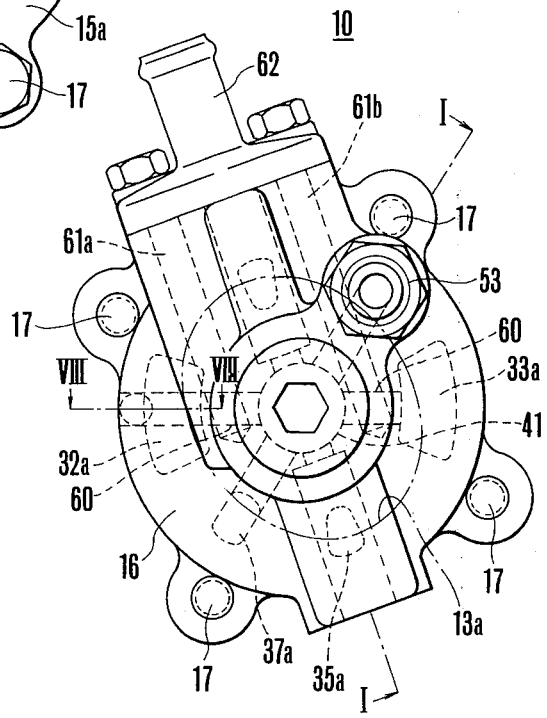
FIG. 3 is a rear end view of the pump shown in FIG. 1.

FIGS. 1 through 3 illustrate one embodiment of the oil pump according to this invention which is constructed for use in a power steering device of a motor car, for example.

The oil pump generally designated by a reference numeral 10 comprises of pump cartridge 14 including a rotor 12 having a plurality of vanes 11, and a cam ring 13 surrounding the rotor 12 and provided with substantially elliptical cam surface 13*a*. Against both sides of the pump cartridge 14 are urged a front body 15 and a rear body 16 respectively thus completing a pump body. Both bodies 15 and 16 are secured by four circumferentially spaced clamping bolts 17 so as to clamp the cam ring 13 therebetween. O rings 18 and 19 are provided for sealing respective joints.

As shown in FIGS. 1 and 2, the front body 15 comprises a circular disc 15*a* joined to one side of the pump cartridge 14 and a cylindrical portion 15*b* projecting in the axial direction from the central portion of the circular disc 15*a*. A drive shaft 20 driven by an internal combustion engine, not shown, extends through the circular disc 15*a* and the cylindrical portion 15*b* for driving the rotor 12, the drive shaft 20 being rotatably supported by a plane bearing 21. The inner end of the drive shaft 20 is fixed by a snup ring 22 which is coupled to the rotor 12 by splines to prevent withdrawal of the drive shaft. As shown, a collar 23 is secured to the front end of the cylindrical portion 15*b*, and an oil seal 24 is provided between the drive shaft 20 and the front end of the collar 23. An oil returning passage 25 is formed through the cylindrical portion 15*b* for returning the operating oil leaking along the drive shaft 20 back to the suction side, and a threaded opening 26 is provided for the outer surface of the cylindrical portion 15*a* for mounting the oil pump 10 on the vehicle body.

As shown in FIG. 4, the pair of pump chambers 30 and 31 formed in the pump cartridge 14 at positions symmetrical with respect to the axis of the rotor 12 are provided with suction ports 32*a* and 33*a* respectively communicating with paired pump suction passages 32 and 33 and discharge ports 34*a*, 35*a*; 36*a*, 37*a* respectively communicating with first and second pump discharge passages 34, 35; 36, 37 which are spaced a predetermined distance in the direction of rotation of the rotor 12. Paired suction ports 32*a*, 33*a*, first discharge ports 34*a*, 35*a*, and second discharge ports 36*a*, 37*a* respectively opened to pump chambers 30 and 31 are positioned symmetrically with respect to the axis of the rotor 12. Pressurized oils discharged from paired first discharge ports 34*a*, 35*a*, and paired second discharge ports 36*a*, 37*a* are supplied to independent passages 34, 35; 36, 37 so as to constitute independent pumps.

More particularly, for the purpose of utilizing the pump cartridge 14 as two pumps, the discharge regions 30 and 31 formed at positions symmetrical with respect to the axis of the rotor are divided into two regions, and paired regions are combined so as to perform balanced pump operation. With this balanced type two stage pump, even when one of the discharge ports is directly connected to the oil tank, not shown, to unload one of the pumps, a balanced load would be imposed upon the rotor so that it is possible to prevent the problem of deflecting the movable portions of the pump to one side causing friction. Accordingly, it is possible to provide a source of pressurized oil having excellent durability and reliability and does not generate noise.

According to this invention, the suction passages 32, 33 which supply oil into respective pump chambers 30 and 31 in the pump cartridge 14, the first and second discharge passages 34, 35; 36, 37 which discharge oil in two directions pressurized by the pump action, are uniquely disposed in the rear body 16 together with a flow control valve acting as a control device that controls the flow of the pressurized oil by taking into consideration the positional relation between the flow control valve and the suction and discharge passages so as to make small, light weight and easy to work the pump.

More particularly, the rear body 16 secured to the rear side of the pump cartridge 14 is formed with a valve opening 41 coaxially with the drive shaft 20 of the rotor 12. The outer end of the opening 41 is hermetically closed by a plug 43 having an O ring 42. Within the valve opening 41 is disposed a spool 44 of the flow control valve 40 which slides in the axial direction of the rear body 16. The spool 44 is biased toward the rotor 12 by a spring interposed between the spool and the plug 43.

The front end of the spool 44 on the side of the rotor 12 is formed with an annular groove 44*a* about its periphery, and as shown in FIGS. 5 and 6, second discharge passages 36 and 37 communicating with the second discharge ports 36*a* and 37*a* are formed at the inner end of the valve opening 41 and perpendicularly thereto at positions corresponding to the annular groove 44*a*.

As can be noted from FIG. 1, the first discharge passages 34, not shown, and 35 communicating with the first discharge ports 34*a* and 35*b* extend in the axial direction toward the rear end of the rear body 16 beyond the second discharge passages 36 and 37 and are communicated with the valve opening 41 through diametrically opposed openings. The openings of the first discharge passages 34 and 35 are normally closed by a land 44*b* near the inner end of the spool 44. As shown in FIGS. 1 and 6, along the outer side of the rear body 16 are formed passages 46 and 47 across the first discharge passages 34 and 35 and communicating with the inner end of the valve opening 41 to contain check valves 48 and 49 which intercept the first discharge passages 34 and 35 from the valve opening 41. Accordingly, the first discharge passages 34 and 35 would be connected to the second discharge passages through the check valves 48 and 49 and the valve opening 41, whereby when spool 44 is inoperative, the pressurized oil from the first discharge ports 34*a* and 35*a* is combined with the pressurized oil from the second discharge ports 36*a* and 37*a* in the second discharge passages 36 and 37. The outer ends of passages 46 and 47 are closed by plugs 46*a* and 47*a* respectively as shown in FIG. 6.

As shown in FIG. 1, a metering discharge passage 50 parallel with the valve opening 41 is provided for the upper side of the rear body 16, the discharge passage 50 being connected with the second discharge passage 36 of the pump at the upper side of the rear body through a metering orifice 51, which detects the flow quantity of the pressurized oil supplied from the second discharge passage 36 of the pump to the discharge passage 50 as a pressure difference between the inlet and outlet of the orifice 51. When the flow quantity exceeds a predetermined quantity, the pressure difference causes the spool 44 to move toward right as viewed in FIG. 1 to successively transfer the first discharge passages 34 and 35 and to maintain the quantities of the pressurized oil sent out from the second discharge passages 36 and 37 below a predetermined quantity. A damper orifice 52 is provided for passing the pressurized oil on the downstream side of the metering orifice 51 to a low pressure chamber of the valve opening 41 in which a spring 45 is disposed. A discharge connector 53 opening to the rear side of the rear body 16 is provided for the discharge passage, and a well known relief valve 54 is provided for the spool 44.

Figure 8:
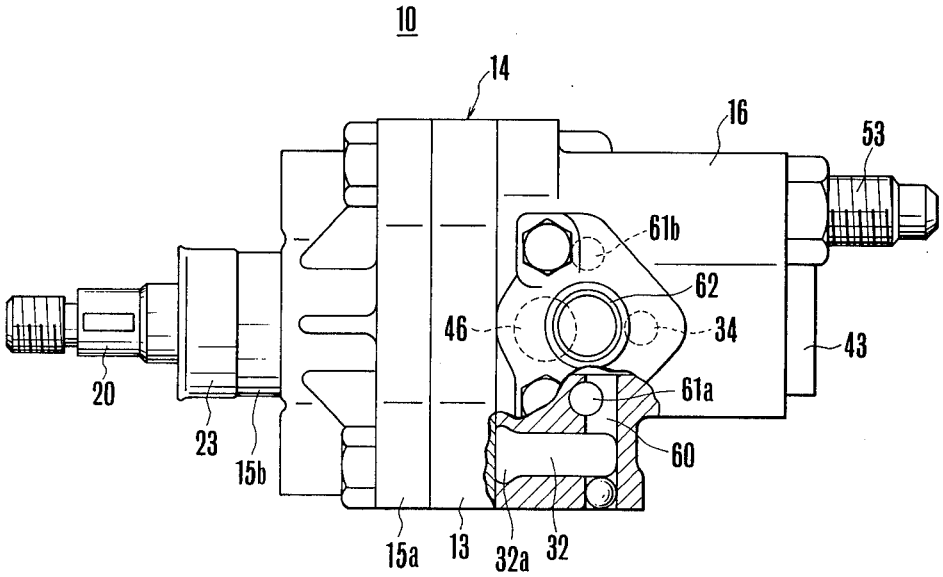
FIG. 8 is a sectional view taken along a line VIII—VIII in FIG. 3.

The suction passages 32 and 33 which convey oil from the tank to the pump chambers 30 and 31 through suction ports 32*a* and 33*a* respectively are interconnected by a passage 60 formed on one side of the rear body 16 through the valve opening 41, as shown in FIGS. 1, 7 and 8 and the passage 60 is communicated with a pair of passages 61*a* and 61*b* extending from the upper cylindrical portion 16*a* of the rear body 16. A suction connector 62 connected to the tank is provided above the cylindrical portion 16*a* for supplying oil to the pair of passages 61*a* and 61*b*.

When forming the pump suction passages 32 and 33 care should be taken such that, the passage 60 interconnecting these suction passages should be positioned between paired openings of the first and second pump discharge passages 34, 35; 36, 37 in the valve opening 41. An annular groove 44*c* corresponding to the opening of the passage 60 is formed at the axial center of the spool 44. When the spool 44 is inoperative, the paired suction passages 32 and 33 are intercommunicated through the annular groove 44*c* and the passage 60.

As the spool 44 is moved to the right when the flow quantity passing through the metering orifice 51 increases, at first the first pump discharge passages 34 and 35 are connected to the suction passages 32 and 33 through the annular groove 44*c* and the passage 60. When the spool 44 is moved further, also the second discharge passages 36 and 37 are connected to the suction passages 36 and 37.

Consequently, with this construction, even when the number of revolutions of the pump is low so that the quantities of the pressurized oil flowing through respective discharge passages 34, 35; 36 and 37 are small the spool 44 is rendered inoperative thus closing the openings of the first discharge passages to the valve opening 41. At this time the pressurized oil opens the check valves 48 and 49 to connect the first discharge passages 34 and 35 with the second discharge passages 36 and 37. Consequently, all of the pressurized oils discharged from the pump chambers 30 and 31 are supplied to the load or fluid machines through the discharge passage 50.

On the other hand, when the number of revolutions of the pump is increased to increase the quantity of output above a predetermined value, the spool 44 is axially moved toward right as viewed in FIG. 1 by the pressure difference created by the metering orifice to sequentially connect the first discharge passages 34 and 35 to suction passages 32 and 33 thus unloading the pump. At the same time check valves 48 and 49 close gradually to disconnect the first discharge passages 34 and 35 from the second discharge passages so that surplus quantity of the pressurized oil discharged from the pump chambers 30 and 31 is returned to the tank, while the remaining oil is supplied to the discharge passage 50 via the second discharge passages 36 and 37. Consequently, the quantity of oil supplied to the load is maintained at a predetermined value. This not only decreases the horse power consumed by the pump but also prevents unbalanced load from imposing upon the rotor 12 thus improving the durability of the movable parts and the reliability of the pump operation.

When the number of revolutions of the pump increases further to increase the quantity of the pressurized oil flowing through the second discharge passages 36 and 37 beyond a predetermined quantity, the spool 44 is moved further by the operation of the metering orifice 51 to sequentially connect these second discharge passages 36 and 37 with the suction passages 32 and 33. As a consequence, a portion of the pressurized oil is returned to the tank thus maintaining the quantity of the pressurized oil supplied through the discharge passage 50 below the predetermined value.

Although in the foregoing embodiment the flow control valve 40 having a flow path transfer function of sequentially connecting the first and second discharge passages 34, 35; 36, 37 to the suction passages and a flow quantity control function of controlling the pressurized oil flowing between the first and second discharge passages and the suction passages is arranged coaxially with the drive shaft 20 of the rotor in the rear body 16, the invention is not limited to this construction. It is only necessary to efficiently arrange the suction passages and the first and second discharge passages in the rear body.

It is also possible to reversely position the spool 44 in the flow control valve 40 to make the side of the plug 43 as the high pressure chamber. The positions of the openings of various passages may be selected correspondingly. Conversely, the first discharge passages may be connected to passage 50 to which the second discharge passages may be connected through check valves.

The discharge passage 50 and the connector 53 on the discharge side are not always necessary to be arranged in the axial direction of the rear body 16. They can be disposed at any positions easy to install relative to respective passages and the valve opening.

Although in the foregoing descriptions, for the purpose of coupling the cam ring 13 constituting the pump cartridge with the front and rear bodies 15 and 16 with bolts, a tongue shaped projection was provided, cylindrical type cam ring may be used while maintaining a required rotational position relative to the body. This construction increases durability.

The load device of the oil pump 10 is not limited to the power steering device but the invention is also applicable to any apparatus operated by pressurized oil and requiring a small and light weight oil pump.

As above described, according to this invention, since a flow control valve in coaxially disposed is a pump body disposed on one side of a pump cartridge and since paired suction passages, first and second discharge passages are opened to confront each other in the valve opening of the control valve it is possible not only to simplify the construction, manufacturing and assembling of various component parts but also to make small and light the overall pump, thus enabling to provide an oil pump of low cost that consumes less power. This improves durability and reliability of the movable parts of the pump. Moreover since various passages are arranged efficiently, the pressure loss in the passages is decreased, whereby the power consumption can be reduced. In addition, since various passages from the discharge ports open in the valve opening at opposing positions, the movement of the spool and its control function can be made smooth and positive. Moreover, as the component elements have substantially the same construction as the prior art component elements most of the component elements of the prior art pump can be used for the pump of this invention.

What is claimed is:

1. An oil pump comprising:

a pump body including a rotor, a cam ring surrounding said rotor and formed with a pair of pump chambers at positions symmetrical with respect to an axis of said rotor;

suction passages and first and second pair of discharge passages opening in said pump chambers at positions a predetermined distance apart in the direction of rotation of said rotor;

a flow control valve formed in the axial direction of said pump body and including a valve opening and a spool slidable therein;

one pair of said discharge passages opening at one end of said valve opening while the other pair opening at an axial center of said valve opening at diametrically opposed positions;

said passages opening at the axial center of said valve opening being normally closed by said spool biased to an inoperative position;

check valves located between two pair of discharge passages;

said suction passages opening in said valve opening at diametrically opposed positions between openings of the two pairs of the discharge passages;

whereby when said spool is operated, said suction passages are first communicated with said other pair of discharge passages opening at the axial center of said valve opening and then communicated with said one pair of discharge passages.

2. The oil pump according to claim 1 wherein said pump body is constituted by a pump cartridge containing said rotor having a plurality of vanes, and said cam ring having an elliptical cam surface engaging said vanes, and a front body and a rear body secured to opposite sides of said cartridge, and said valve opening is formed in said rear body coaxially with said rotor.

3. The oil pump according to claim 1 wherein said spool is formed with an annular groove about its surface and said one pair of discharge passages open into said groove.

4. The oil pump according to claim 1 wherein openings of said first pair of discharge passages open into said valve opening and are normally closed by a land of said spool.

5. The oil pump according to claim 2 wherein a metering discharge passage is provided for said rear body in parallel with said valve opening, and said metering discharge passage is communicated with one of said one discharge passages through a metering orifice which creates a pressure difference for operating said spool.

6. The oil pump according to claim 5 wherein a damper orifice is provided between downstream side of said metering orifice and low pressure side of said spool which is normally closed by a relief valve.

7. The oil pump according to claim 1 wherein said spool is provided with an annular groove at its center which interconnects said pair of suction passages when said spool is inoperative.

* * * * *

UNITED STATES PATENT AND TRADEMARK OFFICE

CERTIFICATE OF CORRECTION

PATENT NO. : 4,443,161

DATED : April 17, 1984

INVENTOR(S) : Naosuke Masuda and Takeshi Ohe

It is certified that error appears in the above-identified patent and that said Letters Patent is hereby corrected as shown below:

Column 6, line 65: change "in coaxially disposed is a pump" to --is coaxially disposed in a pump--

Column 6, line 68: change "are opened" to --are sequentially opened--

Signed and Sealed this

*Nineteenth* Day of *March 1985*

[SEAL]

*Attest:*

DONALD J. QUIGG

*Attesting Officer* *Acting Commissioner of Patents and Trademarks*